US007178742B2

(12) United States Patent
Mellentine et al.

(10) Patent No.: US 7,178,742 B2
(45) Date of Patent: Feb. 20, 2007

(54) FLUID DELIVERY SYSTEM FOR SPRAY APPLICATOR

(75) Inventors: Andrew P. Mellentine, Owosso, MI (US); Joseph T. Donatti, Howell, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 10/430,835

(22) Filed: May 6, 2003

(65) Prior Publication Data

US 2004/0256501 A1 Dec. 23, 2004

(51) Int. Cl.

| | |
|---|---|
| ***B05B 1/24*** | (2006.01) |
| ***B05B 1/00*** | (2006.01) |
| ***B05B 12/00*** | (2006.01) |

(52) U.S. Cl. ..... 239/135; 239/67; 239/69; 239/329; 239/600; 901/43

(58) Field of Classification Search ..... 239/124, 239/135, 142, 398, 399, 421, 424
See application file for complete search history.

(56) References Cited

U.S. PATENT DOCUMENTS

| | | | | |
|---|---|---|---|---|
| 4,584,325 A | | 4/1986 | Smith | |
| 4,616,043 A | | 10/1986 | Smith | |
| 4,695,618 A | | 9/1987 | Mowrer | |
| 4,809,909 A | | 3/1989 | Kukesh | |
| 5,028,017 A | * | 7/1991 | Simmons et al. | 244/134 C |
| 5,059,671 A | | 10/1991 | Taniguchi et al. | |
| 5,203,843 A | * | 4/1993 | Hoy et al. | 239/135 |
| 5,407,132 A | * | 4/1995 | Messerly et al. | 239/124 |
| 5,468,518 A | | 11/1995 | Lein et al. | |
| 5,723,518 A | | 3/1998 | Kahl et al. | |
| 5,755,884 A | * | 5/1998 | Buckler et al. | 118/317 |
| 6,290,024 B1 | * | 9/2001 | Ehlert | 184/6.26 |
| 6,293,742 B1 | * | 9/2001 | Miyagi et al. | 409/132 |
| 6,319,559 B1 | | 11/2001 | Makino | |
| 6,495,272 B1 | | 12/2002 | Creber et al. | |
| 6,499,675 B2 | * | 12/2002 | Huang et al. | 239/424.5 |
| 6,521,298 B1 | | 2/2003 | Banks | |

FOREIGN PATENT DOCUMENTS

| | | |
|---|---|---|
| DE | 2 221 168 | 11/1973 |
| DE | 690 040 441 T2 | 3/1994 |
| DE | 195 24 853 C2 | 1/1996 |
| DE | 689 23 931 T2 | 1/1996 |
| DE | 297 14 302 U1 | 8/1998 |
| EP | 0 983 797 A2 | 3/2000 |

* cited by examiner

*Primary Examiner*—Kevin Shaver
*Assistant Examiner*—Darren Gorman
(74) *Attorney, Agent, or Firm*—Brooks Kushman P.C.

(57) ABSTRACT

A fluid delivery system is provided as a modular system. The fluid delivery system provides a fluid to a robotic spray applicator system that may be used to spray a mold with a motor release compound or in-mold coating. The fluid to be dispensed is contained in the drum and is provided through a fluid circuit including a peristaltic pump, a filter and a heater. The fluid is pumped through the fluid circuit to an applicator that dispenses the fluid onto a mold. The system may also be used in conjunction with adhesives or other compositions that must be filtered, heated and provided to a spray applicator at a metered flow rate. The fluid delivery system may be used in conjunction with a robotic system. The displacement of the peristaltic pump may be controlled by a variable frequency drive or may be controlled by a programmable logic controller of the robotic system.

10 Claims, 1 Drawing Sheet

FLUID DELIVERY SYSTEM FOR SPRAY APPLICATOR

BACKGROUND OF THE INVENTION

1. Field of the Invention

The present invention relates to a fluid delivery system for a spray applicator that includes subsystems for filtering, heating and metered pumping of a fluid.

2. Background Art

Fluid delivery systems for spray applicators generally include a pump disposed in a chemical drum that supplies fluid to the spray applicator. Such systems may include flow meters for metering the supply of fluid. Other systems use backflow regulation to control the rate of flow to the spray applicator.

Some fluids such as in-mold coatings, adhesives and mold release agents pose problems for spray applicator systems due to the nature of the product being dispensed. For example, in-mold coatings that comprise pigmented coatings applied to a mold surface tend to accumulate in flow meters. Over time, the accuracy and effectiveness of flow meters degrades when used with in-mold coatings. Similarly, adhesives and mold release compounds tend to build up on internal surfaces of flow meters causing them to become clogged.

In-mold coatings and mold release compounds should be applied under controlled conditions in manufacturing operations to assure consistent molding results. The temperature at which such compounds are dispensed may materially affect performance and, in particular, the time required for such compositions to flash off. Flash off time, if not controlled, can lead to longer processing cycle times.

Foreign objects and impurities in chemicals that are to be dispensed with a spray applicator may interfere with spraying operations and may cause expensive spray guns and flow meters to become clogged or jammed.

There is a need for a fluid dispensing system for spray applicators that improves process control by permitting the material to be heated to an optimal temperature and also includes adequate filtration and a pumping system that accurately meters the quantity of fluid dispensed. There is also a need for such a system that is portable and may be easily connected and changed out on production spray applicator equipment.

These and other problems are addressed by applicants' invention as summarized below.

SUMMARY OF THE INVENTION

According to one aspect of the present invention a fluid delivery system for a fluid that is to be dispensed by a spray applicator is provided. The fluid delivery system comprises a fluid container, such as a drum, that contains the fluid to be dispensed and a spray applicator that dispenses the fluid. A peristaltic pump pumps a metered quantity of fluid from the fluid container to the fluid applicator. A pump controller controls the rate of displacement of the peristaltic pump. A fluid circuit including a filter and a heater is provided through which fluid is pumped by the peristaltic pump so that a metered amount of fluid that has been filtered and heated is supplied to the spray applicator.

According to another aspect of the present invention, the fluid delivery system may be used in conjunction with a robotic system for manipulating the spray applicator. The robotic system has a programmable logic controller that provides an input to the pump controller of the fluid delivery system to control the rate of displacement of the peristaltic pump. The peristaltic pump draws fluid from the container through the filter, the heater, and the peristaltic pump itself before being provided to the spray applicator. A color change valve may be provided between the pump and the spray applicator to permit different color pigments to be added to the fluid.

According to another aspect of the invention the fluid delivery system may be provided as a modular unit. The modular unit may comprise a pallet on which the fluid container, peristaltic pump, filter and heater are secured along with other associated elements of the fluid circuit.

According to other aspects of the invention the fluid to be dispensed may be a colored polyurethane based in-mold coating, a mold release compound, or adhesive.

According to other aspects of the invention the temperature of the fluid to be dispensed may be heated to at least 10° F. above ambient temperature to assure process control and accelerate flash off of the fluid. The fluid delivery system may be used with a heated mold onto which the fluid is dispensed. The fluid to be dispensed may be an in-mold coating that is heated to between 10° F. above ambient temperature and 120° F. while the mold may be heated to between 140° F. to 180° F. and preferably 160° F.

These aspects of the invention and others will be apparent to one of ordinary skill in the art upon review of the attached drawings in light of the following detailed description of the preferred embodiment of the present invention.

DETAILED DESCRIPTION OF THE PREFERRED EMBODIMENT(S)

Figure 1:
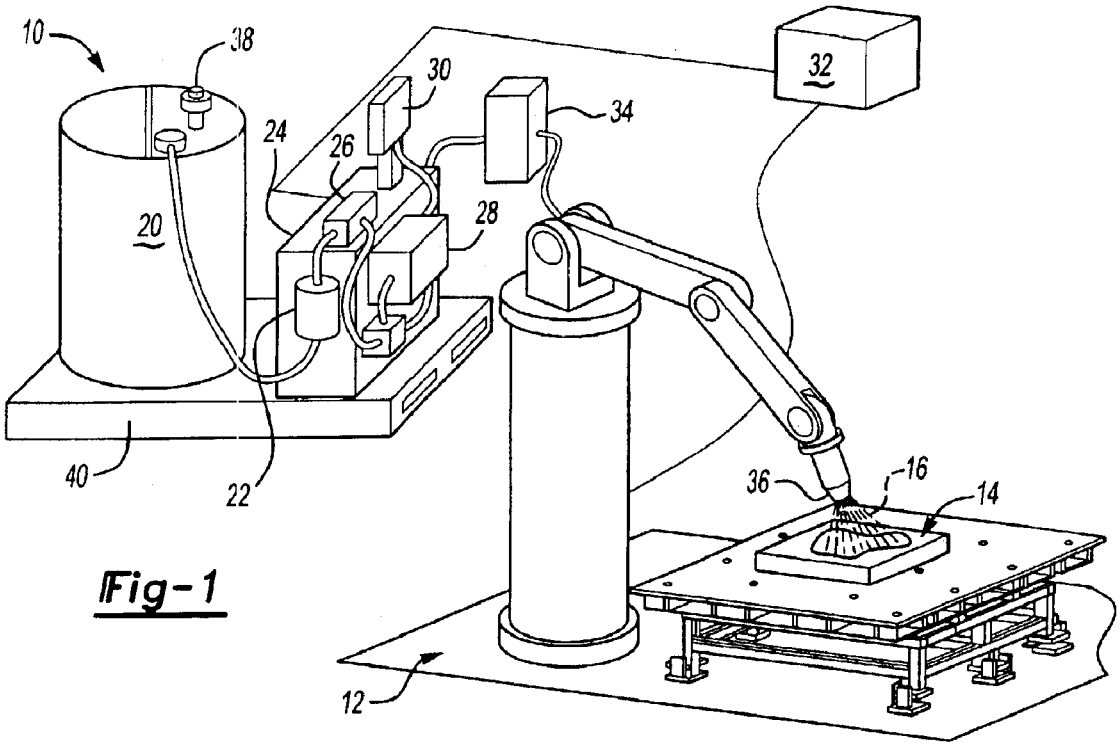
FIG. 1 is a perspective schematic view of a fluid delivery system in conjunction with a robotic system for manipulating a spray applicator to spray a fluid on a mold.
Figure 2:
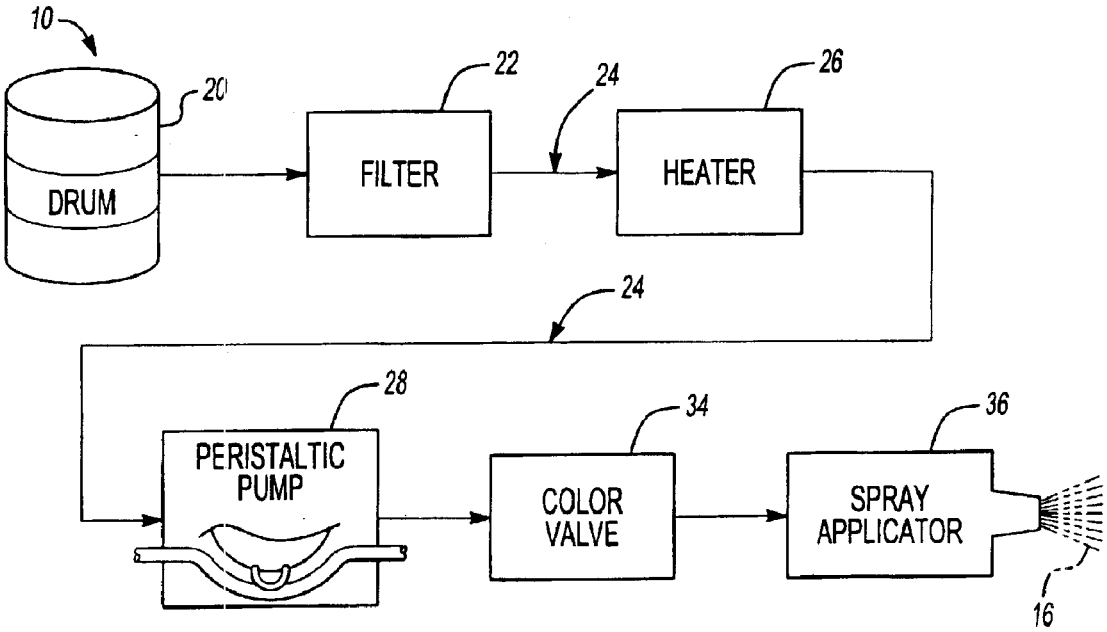
FIG. 2 is a flow chart illustrating the components of the fluid delivery system.

Referring to FIGS. 1 and 2, the fluid delivery system 10 of the present invention is shown in conjunction with a robotic system 12 and a mold 14 on to which a fluid spray 16 is applied. The fluid delivery system 10 includes a drum 20, or container, from which the fluid 16 is drawn. The fluid 16 is drawn through a filter 22. The filter is provided to remove large particles and foreign material from the fluid 16. The fluid may be a relatively course sponge filter or "sock" filter. The filter 22 is connected in a fluid circuit 24 between the drum 20 and a heater 26. Heater 26 is provided to heat the fluid to a desired temperature. The fluid is preferably provided at a temperature at least 10° above ambient temperature for the system. The fluid is a polyurethane in-mold coating that may be used to provide a urethane base color coat for a multi component polyurethane spray forming process. Such in-mold coating compounds are abrasive and tend to cause excessive wear on seals provided in conventional pumps.

It has been found that an optimal temperature for applying a urethane based color coat fluid is approximately 120° F. The temperature may vary from 120° F. to 180° F. but is preferably at least 10° F. above the ambient temperature for the fluid delivery system so that the fluid 16 is always heated to a known temperature. When the fluid is heated to a known temperature process times may be automatically adjusted to compensate for variations in temperature so that adequate time is provided for the fluid to flash off after being applied to the mold.

A peristaltic pump 28 is used to draw fluid 16 through the fluid circuit 24. The peristaltic pump 28 includes a conduit through which the fluid is moved by means of a rotating lobed pump element. The fluid is contained within a flexible tube as it is pumped. The lobed rotating element engages the tube, without directly contacting the fluid and moves the fluid through the tube. The peristaltic pump 28 is controlled by a variable frequency drive (VFD) that can be controlled by a controller that is associated with the robotic system 12. The controller is preferably a programmable logic controller that can control the rate of displacement of the peristaltic pump according to the flow requirements of the system. The peristaltic pump 28 has a pump controller 30 that may be controlled by a programmable logic control 32 of the robotic system 12.

The fluid 16 is then directed to a color valve 34. The color valve 34 permits pigment to be added to the fluid, if desired, so that a colored in-mold coating may be provided to the spray applicator 36. The spray applicator 36 is a spray gun or nozzle that applies an in-mold coating, mold release compound or adhesive with an airless spraying process.

The fluid is preferably conditioned by means of an agitator 38 that maintains the fluid 16 in a well mixed state.

The fluid delivery system 10 is modular system that may be set up at a spray forming production line and may be quickly changed out by substituting a new module when the fluid 16 in the drum 20 is depleted. The module may be simply set up on a pallet 40 containing the fluid container 20, peristaltic pump 28, filter 22, and heater 26 along with their associated fluid circuit elements 24, power and pneumatic inputs.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A fluid delivery system for a fluid to be dispensed comprising:

a fluid container that contains the fluid;

a spray applicator that dispenses the fluid;

a peristaltic pump that pumps a metered quantity of the fluid from the fluid container to the fluid applicator, wherein the peristaltic pump has a variable frequency drive that can be controlled according to spray applicator flow requirements;

a pump controller that controls the rate of displacement of the peristaltic pump;

a fluid circuit through which the fluid is pumped by the peristaltic pump;

a filter connected to fluid circuit through which the fluid is pumped to filter the fluid; and a heater connected to fluid circuit through which the fluid is pumped for heating the fluid to a controlled temperature, wherein a metered amount of fluid that has been filtered and heated is supplied to the spray applicator.

2. The fluid delivery system of claim 1 wherein the peristaltic pump draws the fluid from the container through the filter, then through the heater, and then through the peristaltic pump before being provided to the spray applicator.

3. The fluid delivery system of claim 1, further comprising a pallet on which the fluid container, peristaltic pump, filter, and heater arc secured as a modular unit.

4. The fluid delivery system of claim 1 wherein the fluid to be dispensed is a mold release compound.

5. The fluid delivery system of claim 1 wherein the fluid to be dispensed is an adhesive.

6. The fluid delivery system of claim 1 wherein the temperature of the fluid is heated to at least 10 degrees Fahrenheit above ambient temperature for the system to assure process control by accelerating flash off of the fluid.

7. The fluid delivery system of claim 1 further comprising a heated mold onto which the fluid is dispensed and wherein the fluid to be dispensed is an in mold coating that is heated to between 10 degrees Fahrenheit above ambient temperature and 120 and degrees Fahrenheit and the mold is heated to between 140 degrees Fahrenheit and 180 degrees Fabrenheit.

8. A fluid delivery system for a fluid to be dispensed comprising:

a fluid container that contains the fluid;

a spray applicator that dispenses the fluid;

a peristaltic pump that pumps a metered quantity of the fluid from the fluid container to the fluid applicator;

a pump controller that controls the rate of displacement of the peristaltic pump;

a fluid circuit through which the fluid is pumped by the peristaltic pump;

a filter connected to fluid circuit through which the fluid is pumped to filter the fluid;

a heater connected to fluid circuit through which the fluid is pumped for heating the fluid to a controlled temperature, wherein a metered amount of fluid that has been filtered and heated is supplied to the spray applicator; and a robotic system for manipulating the spray applicator, the robotic system having a programmable logic controller, wherein the pump controller receives an input from the programmable logic controller of the robotic system so control the rate of displacement of the peristaltic pump.

9. A fluid delivery system for a fluid to be dispensed comprising:

a fluid container that contains the fluid, the fluid comprising a colored polyurethane based in mold coating;

a spray applicator that dispenses the fluid;

a peristaltic pump that pumps a metered quantity of the fluid from the fluid container to the fluid applicator;

a pump controller that controls the rate of displacement of the peristaltic pump;

a fluid circuit through which the fluid is pumped by the peristaltic pump;

a filter connected to fluid circuit through which the fluid is pumped to filter the fluid;

a heater connected to fluid circuit through which the fluid is pumped for heating the fluid to a controlled temperature, wherein a metered amount of fluid that has been filtered and heated is supplied to the spray applicator.

10. The fluid delivery system of claim 9 wherein the fluid is provided by the peristaltic pump to a color change valve wherein at least one pigment may be added to the fluid.

* * * * *